US006019370A

United States Patent [19]

Morris

[11] Patent Number: 6,019,370

[45] Date of Patent: Feb. 1, 2000

[54] EDUCATIONAL BOARD GAME

[76] Inventor: Harry W. Morris, 4601 Lanham #5, Midland, Tex. 79705

[21] Appl. No.: 09/119,259

[22] Filed: Jul. 20, 1998

[51] Int. Cl.[7] ..... A63F 3/00; A63F 9/18

[52] U.S. Cl. ..... 273/249; 273/431

[58] Field of Search ..... 273/249, 248, 273/243, 250–254, 429–432

[56] References Cited

U.S. PATENT DOCUMENTS

| | | | |
|---|---|---|---|
| 1,635,734 | 7/1927 | Ziegler . | |
| 4,124,214 | 11/1978 | Pavis | 273/249 |
| 4,326,711 | 4/1982 | Giallombardo | 434/327 |
| 4,368,889 | 1/1983 | Reker, Jr. | 273/243 |
| 4,372,559 | 2/1983 | Summers | 273/243 |
| 4,416,454 | 11/1983 | Delamontagne | 273/243 |
| 4,449,710 | 5/1984 | Davis | 273/249 |
| 4,684,136 | 8/1987 | Turner | 273/271 |
| 4,714,254 | 12/1987 | Calloway | 273/249 |
| 4,854,594 | 8/1989 | Eaton | 273/249 |
| 4,877,254 | 10/1989 | Yuscavage | 273/249 |
| 4,940,239 | 7/1990 | Tuttle | 273/243 |
| 4,962,934 | 10/1990 | Taylor | 273/249 |
| 4,998,735 | 3/1991 | Blackwell, III | 273/249 |
| 5,007,650 | 4/1991 | Reed et al. | 273/249 |
| 5,106,097 | 4/1992 | Levine | 273/237 |
| 5,156,407 | 10/1992 | Moore | 273/249 |
| 5,211,402 | 5/1993 | Ferguson et al. | 273/249 |
| 5,257,939 | 11/1993 | Robinson et al. | 434/129 |
| 5,310,346 | 5/1994 | Dillhoff | 434/167 |
| 5,445,389 | 8/1995 | Jeffreyes, Jr. | 273/243 |

*Primary Examiner*—Benjamin H. Layno

*Attorney, Agent, or Firm*—Akin, Gump, Strauss, Hauer & Feld, L.L.P.

[57] ABSTRACT

An educational board game includes a game board having a playing surface defined by a travel path divided into plural spaces arranged seriatim and defined by at least one of number, color and subject matter indicia, such spaces being disposed between a "start space" and a "finish space" on the travel path. Multiple players use individual playpieces to advance along the travel path from start to finish. Players take turns attempting to advance along the travel path by correctly answering questions from a selection of questions and answers printed in a book according to selected subject matter categories. Players advance their playpieces by correctly answering the questions. Questions and subject matter categories are selected by chance through rolling a set of dice whose numbers identify the subject matter category and question. Gaming chips may be used to accumulate extra points toward determining a game winner and through betting by the player whose turn it is to answer a question and by challenges to the answer by other players in the game. The game subject matter categories may be derived around a theme, such as college life in a particular group of colleges based on an athletic conference, for example.

25 Claims, 8 Drawing Sheets

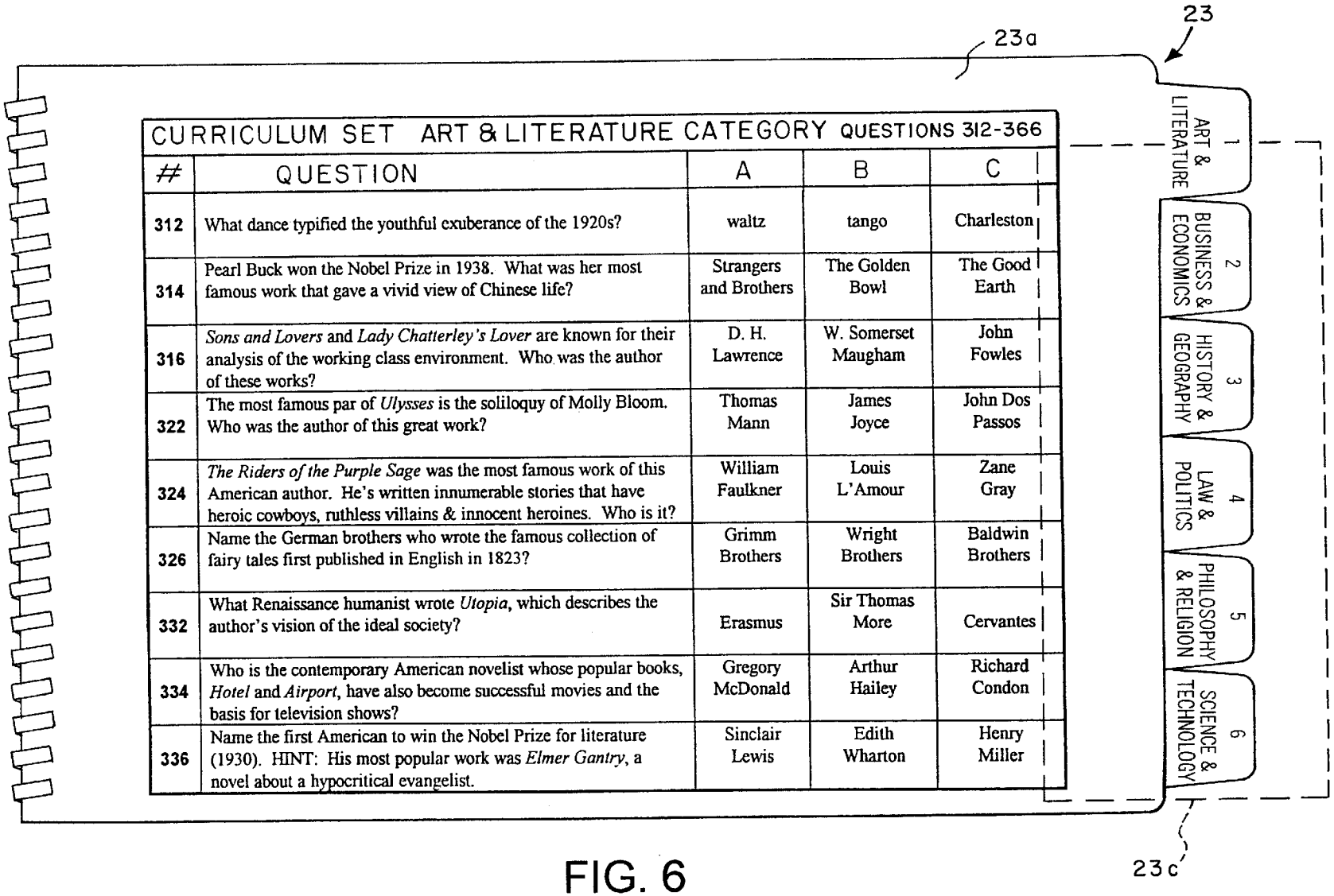

CURRICULUM SET ART & LITERATURE CATEGORY QUESTIONS 312-366

| # | QUESTION | A | B | C |
|---|---|---|---|---|
| 312 | What dance typified the youthful exuberance of the 1920s? | waltz | tango | Charleston |
| 314 | Pearl Buck won the Nobel Prize in 1938. What was her most famous work that gave a vivid view of Chinese life? | Strangers and Brothers | The Golden Bowl | The Good Earth |
| 316 | *Sons and Lovers* and *Lady Chatterley's Lover* are known for their analysis of the working class environment. Who was the author of these works? | D. H. Lawrence | W. Somerset Maugham | John Fowles |
| 322 | The most famous par of *Ulysses* is the soliloquy of Molly Bloom. Who was the author of this great work? | Thomas Mann | James Joyce | John Dos Passos |
| 324 | *The Riders of the Purple Sage* was the most famous work of this American author. He's written innumerable stories that have heroic cowboys, ruthless villains & innocent heroines. Who is it? | William Faulkner | Louis L'Amour | Zane Gray |
| 326 | Name the German brothers who wrote the famous collection of fairy tales first published in English in 1823? | Grimm Brothers | Wright Brothers | Baldwin Brothers |
| 332 | What Renaissance humanist wrote *Utopia*, which describes the author's vision of the ideal society? | Erasmus | Sir Thomas More | Cervantes |
| 334 | Who is the contemporary American novelist whose popular books, *Hotel* and *Airport*, have also become successful movies and the basis for television shows? | Gregory McDonald | Arthur Hailey | Richard Condon |
| 336 | Name the first American to win the Nobel Prize for literature (1930). HINT: His most popular work was *Elmer Gantry*, a novel about a hypocritical evangelist. | Sinclair Lewis | Edith Wharton | Henry Miller |

FIG. 6

23

23b

| CURRICULUM SET | ART & LITERATURE CATEGORY | QUESTIONS 312 - 366 |
|---|---|---|
| # | ANSWER & COMMENT | |
| 312 | (c) The song "Charleston" was introduced in 1923 in the all-Negro revue *Running Wild*. The dance became the favorite in ballrooms across America. | |
| 314 | (c) *The Good Earth*. A semi-autobiographical work, *Strangers and Brothers* was written by the English author C. P. Snow. An American novelist and playwright, Henry James, wrote *The Golden* Bowl, as well as *The Bostonians* and *Portrait of a Lady*. James' purpose in writing was to illustrate and define morality. | |
| 316 | (a) Lawrence. Maugham wrote *Cakes and Ale*, and Fowles wrote *The French Lieutenant's Woman*. | |
| 322 | (b) Joyce. The events of Ulysses cover a single day. Joyce's accomplishment is to take the life of an ordinary man and give it significance. The American author Dos Passos is known for *Manhattan Transfer*, while German Thomas Mann won the Nobel Prize for *The Magic Mountain*. | |
| 324 | (c) Gray. Faulkner's writings are based on his family's history and the violence he witnessed in the South. He is known for *The Sound and the Fury*. L'Amour wrote a series featuring Hopalong Cassidy. He is also known for *Hondo* and *How the West Was Won*. | |
| 326 | (a) Grimm Brothers. Among the best-loved Grimm fairy tales are *Rumplestilskin* and *The Goose Girl*. | |
| 332 | (b) The Englishman More (1478-1535) was heavily influenced by Plato's *Republic* and the emerging New World. Like most Utopians, his idealistic views are overshadowed by impracticality. | |
| 334 | (b) Hailey. McDonald authored a number of novels featuring his characters, Fletch and Flynn. Condon is best known for his variety of novels, many of which have become films such as *The Manchurian Candidate* and *Prizzi's Family*. | |
| 336 | (a) Lewis also wrote *Main Street* and *Babbitt*. Miller wrote *Tropic of Cancer* and *Tropic of Capricorn*. Wharton wrote *Ethan Frome*, as well as many great ghost stories. | |

1 ART & LITERATURE | 2 BUSINESS & ECONOMICS | 3 HISTORY & GEOGRAPHY | 4 LAW & POLITICS | 5 PHILOSOPHY & RELIGION | 6 SCIENCE & TECHNOLOGY

FIG. 7

EDUCATIONAL BOARD GAME

FIELD OF THE INVENTION

The present invention pertains to a board game for multiple players which combines the elements of chance, calculated risk and the tests of the players' knowledge of selected ranges of subject matter.

BACKGROUND

Myriad board games have been developed which emphasize, primarily, entertainment only or have a fantasy-like theme. However, persons of virtually all ages are also entertained and enjoy a game setting in which a person's knowledge of a particular subject is challenged and the game participants receive educational benefits from playing the game. There is, of course, the ever present desire for an entertainment aspect of a game in which a somewhat controlled element of chance or risk taking, otherwise referred to as gambling or betting, is present. Heretofore, there has been a lack of board games which combine educational benefits, the elements of chance, the elements of controlled risk taking or betting and wherein the subject matter of the game can be varied widely, all while providing superior entertainment value. It is to these ends that the present invention has been developed.

SUMMARY OF THE INVENTION

The present invention provides an improved board game, particularly adapted for multiple players, wherein the elements of chance, calculated risk taking or betting, tests of the players' knowledge of various subjects and educational benefits of providing correct answers to a wide range of questions in various categories of subject matter are combined in a game providing superior entertainment value.

In accordance with one important aspect of the present invention, a board game is provided which is adapted for play by education conscious persons who may select a game on the basis of a general category of subject matter in order to be able to discuss favorite subjects and to be challenged to answer questions in various specific categories of subject matter as the primary play activity or "object" of the game.

In accordance with another aspect of the invention, a board game is provided wherein each player's play event or "turn" at playing the game, involves an element of chance in tossing dice to select a specific category of subject matter and a question number from a book of questions and answers for each specific category of subject matter within a broad category of subject matter serving as the basis for the theme of the game. For example, the theme of the game may be college campus life and may be centered around a set of questions and answers involving a specific group of colleges such as a group based on an athletic conference or organization, i.e. the Ivy League, Southeastern Conference, or Big Twelve Conference, for example.

In accordance with another aspect of the invention, a board game is provided which introduces several elements of chance, including the selection of a category of subject matter of which the player's knowledge is tested, the player's ability to advance along the game board from a start point to a finish, a penalty aspect of the game in which the player's degree of advancement along the board or loss of turn amongst other players may be introduced and wherein, through calculated risk, a player may challenge another person's answer to a question to gain advantages in pursuit of the object of the game.

Still further, those skilled in the art will recognize that a unique type of board game has been developed which includes several elements of gaming together with educational and entertainment aspects which, in combination, have heretofore been unappreciated. Moreover, those skilled in the art will also recognize the above-mentioned features and advantages of the game of the present invention together with other superior aspects thereof upon reading the detailed description which follows in conjunction with the drawing.

BRIEF DESCRIPTION OF THE DRAWING

FIG. 6 is a view of one page of a question and answer book showing exemplary questions and multiple choice answers in an exemplary format in accordance with the invention; and FIG. 7 is a view of the opposite side of the page shown in FIG. 6 illustrating the correct answers to the questions stated on the page shown in FIG. 6, and including commentary related to the answers.

DETAILED DESCRIPTION OF A PREFERRED EMBODIMENT

Figure 1:
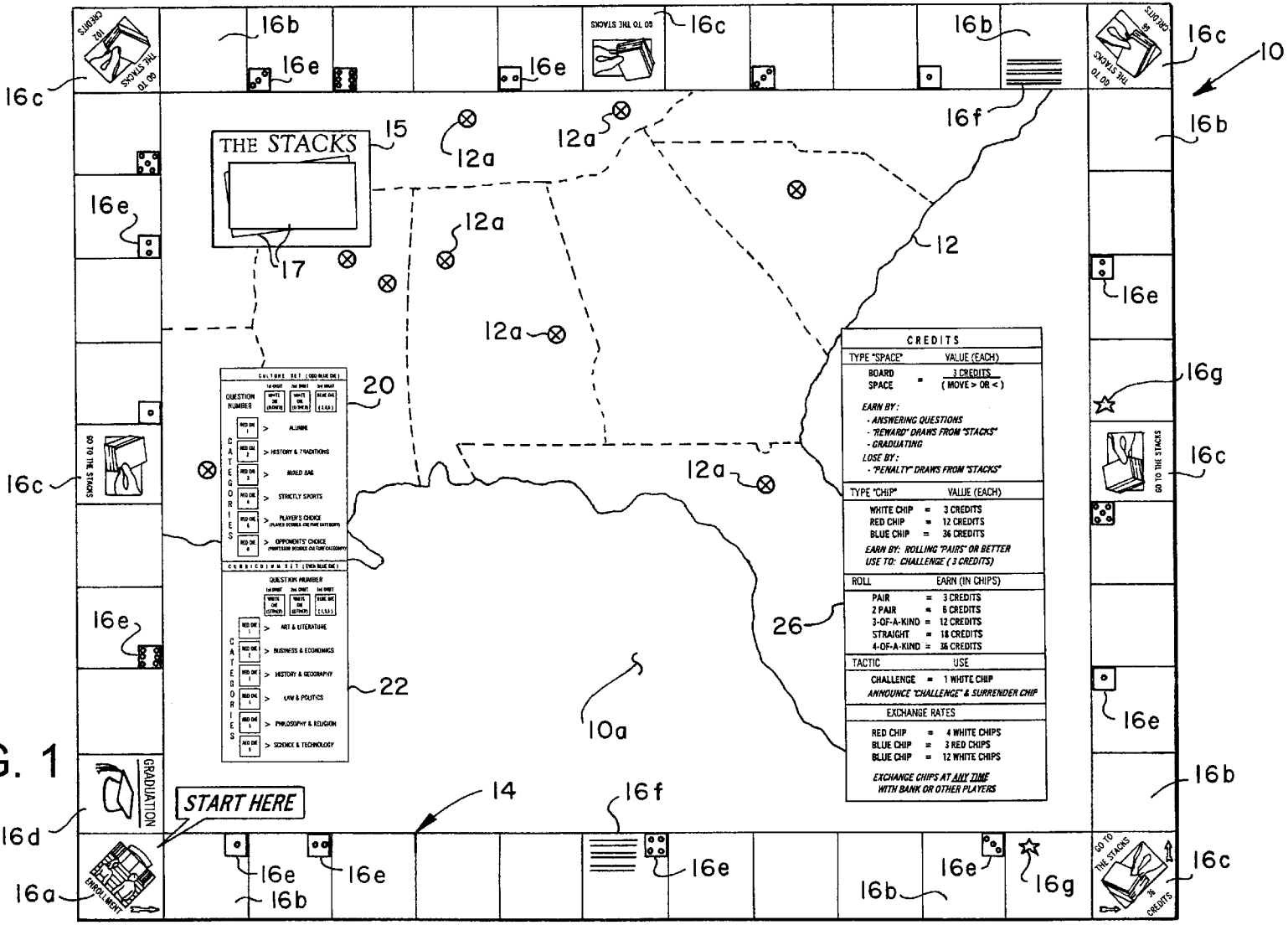
FIG. 1 is a plan view of a game board in accordance with one preferred embodiment of the game of the present invention.

In the description which follows, like elements are marked throughout the specification and drawing with the same reference numerals, respectively. The drawing features are not necessarily to scale and certain elements may be shown in somewhat schematic or generalized form in the interest of clarity and conciseness.

A preferred embodiment of a board game in accordance with the invention may, for example, without limitation, use as a theme, subject matter concerning a group of colleges belonging to a collegiate athletic conference. By way of example only, a collegiate athletic conference involving colleges located in a particular geographic area is illustrated by a game board as shown in FIG. 1 and generally designated by the numeral 10. The game board 10 includes a substantially planar surface 10*a* on which is provided a graphic display comprising a map of the region of the United States, indicated at 12, to include several states in the southeastern part of the country. The locations of major colleges located in this region and belonging to a particular athletic conference may be indicated by the geographic indicators 12*a* and further indicia may be used, not shown, to identify the respective colleges. Such colleges may be considered the subject of at least selected sets of questions and answers regarding the cultural aspects of the board game of the invention. For the sake of describing an exemplary game in accordance with the invention, the remainder of this discussion may refer to certain features which are peculiar to a group of colleges located in the geographical region 12 shown on the game board 10.

Referring further to FIG. 1, the game board 10 is provided with a perimeter playpiece travel path 14 divided into plural squares or game playpiece placement positions or spaces 16*a*, 16*b*, 16*c* and 16*d*, as indicated. Each playpiece space 16*b* may have suitable indicia thereon associated with a particular college, such as a geographical feature of the college, an image of a famous graduate of the college, or an image of an athletic team trademark, nickname or mascot, for example. Certain ones of the spaces 16*c* may also, if occupied by a playpiece provide certain consequences or rewards. For example, each space 16*c*, if occupied by a playpiece, may require that the player whose playpiece has landed on that space retreat several spaces toward the start or "enrollment" space, 16*a*. Alternatively, if a playpiece lands on a space 16*c*, the player may advance his playpiece to a further space leading to the final or objective space 16*d*. The first player to reach space 16*d* may be declared the winner of the game. In particular, one aspect of the board game of the present invention requires that a player whose playpiece lands on a space 16*c* draw an action card 17 FIG. 1, from a stack of cards residing on the game board 10.

Figure 2:
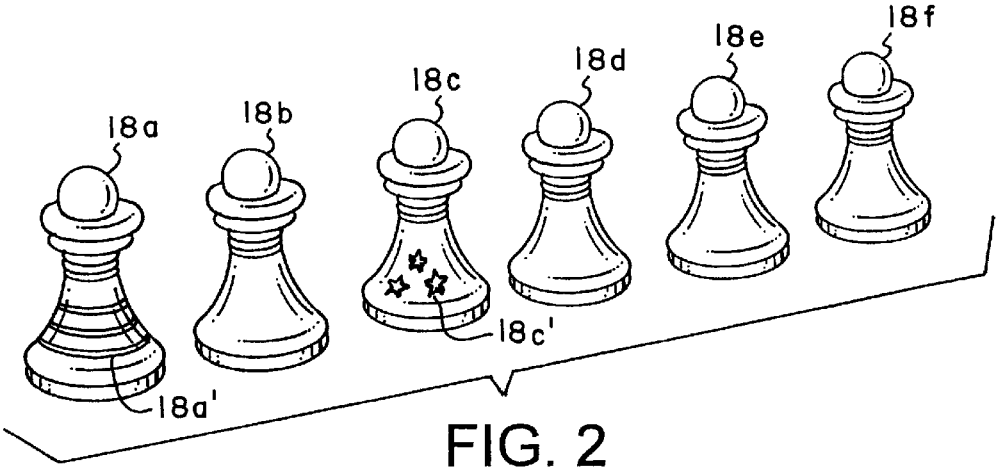
FIG. 2 is a perspective view of plural playpieces for the board game of the present invention.

Players of the game of the present invention keep track of their position along the travel path 14 using one of playpieces 18*a* through 18*f*, for example, as illustrated in FIG. 2. The configurations of the playpieces 18*a* through 18*f* are merely exemplary and the playpieces may take various forms or at least be provided in various colors or other indicia such as stripes 18*a*' or design elements 18*c*', for example, to provide suitable identification with the player using a particular playpiece and for other purposes described herein.

Figure 1A:
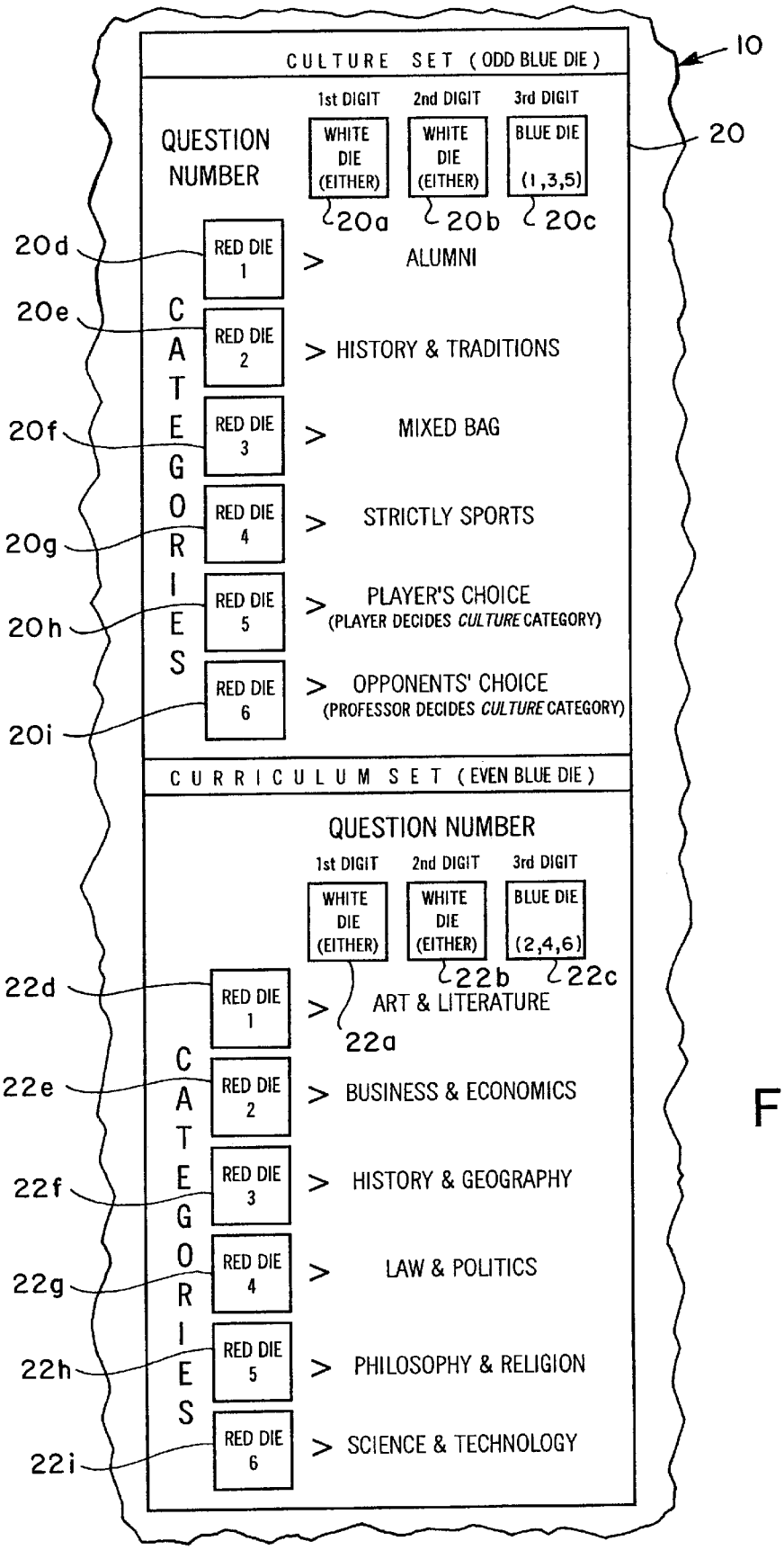
FIGS. 1A through 1H are detail views on a larger scale of portions of the game board shown in FIG. 1.
Figure 3:
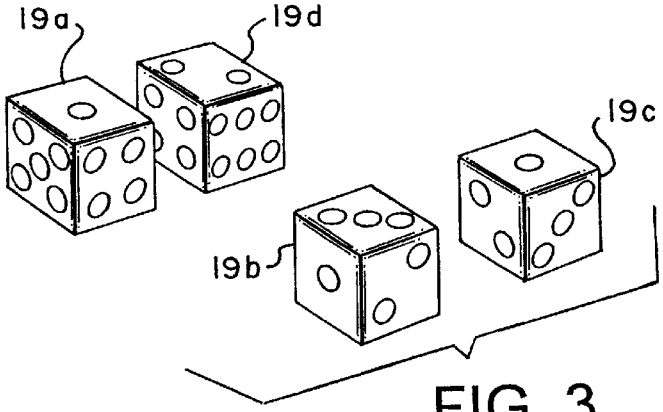
FIG. 3 is a perspective view of four dice used in conjunction with the game of the present invention.

Referring further to FIGS. 1 and 1A, the game of the present invention is also, advantageously, provided with at least two die grids 20 and 22 which may be printed on the game board 10 and are used in conjunction with up to four dice, including a red die 19*a*, FIG. 3, two white dice 19*b* and 19*c* and a blue die 19*d*. The die colors are exemplary and other color combinations may be used. The dice 19*a* through 19*d* are rolled by a player during the player's turn at play to select a category of subject matter within which questions are asked of the player during that player's turn. If the player provides a correct answer to the question selected by a roll of the dice, the player advances his or her playpiece along the travel path 14. By way of example, the die grid 20 has suitable spaces 20*a*, 20*b* and 20*c*, FIG. 1A, for placement of two white dice and one blue die, for example. The spaces 20*d* through 20*i* are provided for placement of a red die, for example, in accordance with the appropriate number rolled and which indicates the specific category of subject matter of a question to be asked of the player. Die grid 22 is similar to die grid 20 and is used if the blue die, when rolled, shows an odd number up. Die grid 20 is used to select the category and question when an even number results from a roll of the blue die. Spaces 22*a* through 22*i* are provided for placement of the appropriate dice indicated on the grid 22 if a roll of the blue die turns up an even number.

Accordingly, as indicated in the die grids 20 and 22, if a blue die is rolled with an odd number turning up, a broad category of subject matter is the Culture Set and the number of the blue die together with the number rolled for each of the white dice determines a question number. The number rolled for a red die indicates the specific category of questions, as indicated. For example, the questions will be related to "History and Traditions" if the red die is rolled with number two turning up, for space 20*e*, or "Strictly Sports" if the number four is rolled with the red die to occupy space 20*g*. As shown further in the partial plan view of the game board 10 in FIG. 1A, if an even numbered blue die is rolled, the subject matter category centers around the so-called Curriculum Set of questions and the question number and specific category are determined by the number rolled for the two white dice and the blue die (question number) as well as the number rolled for the red die (specific category).

Figure 1B:
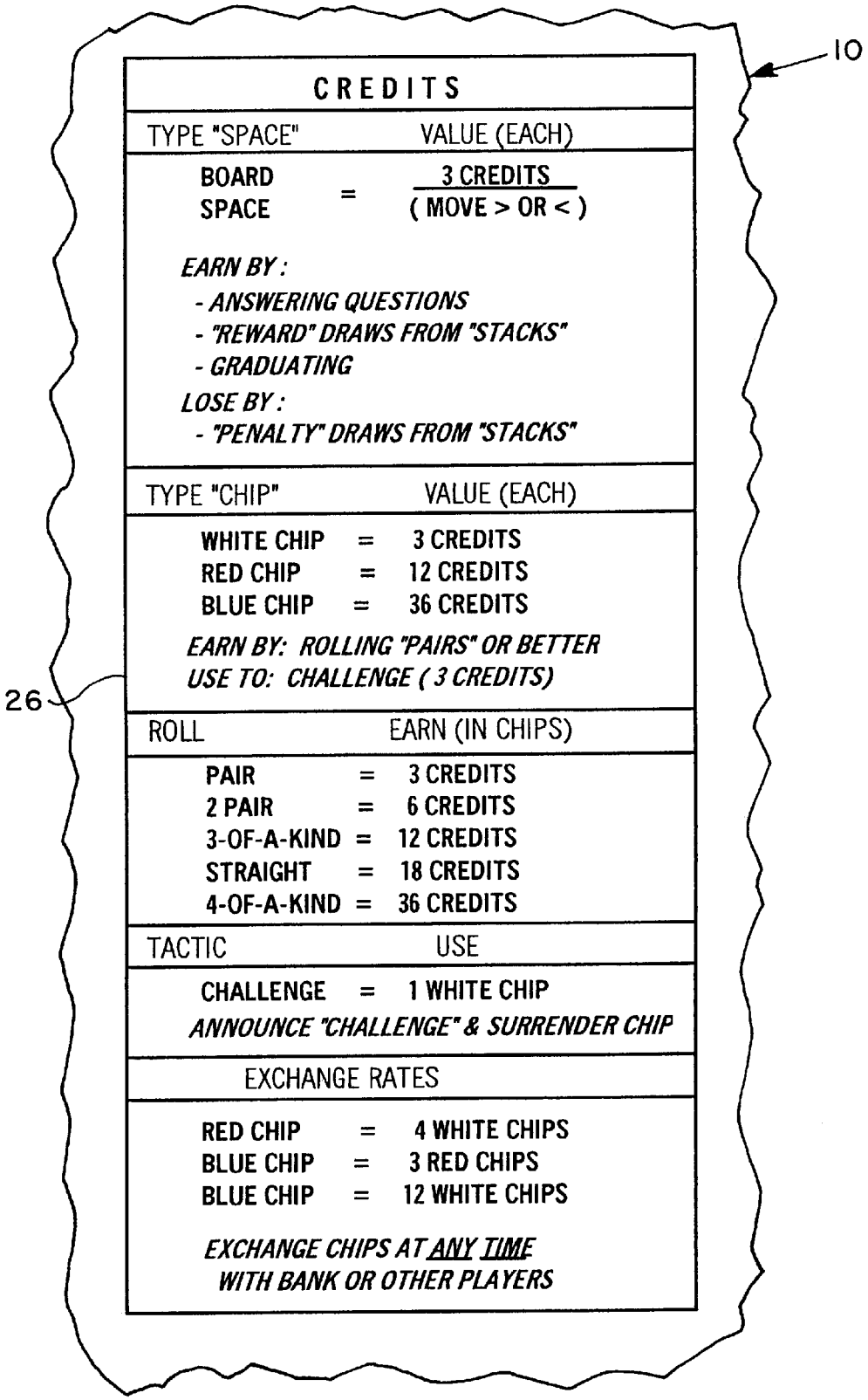
Figure 1C:
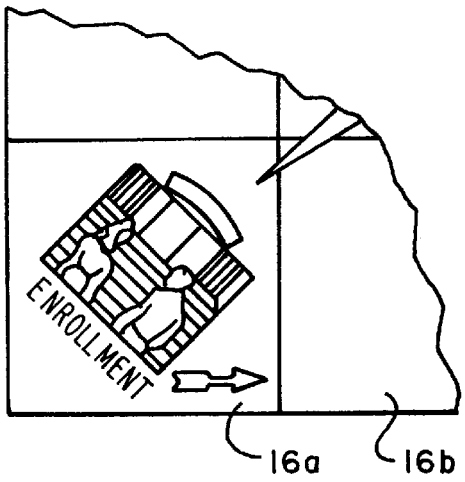
Figure 4:
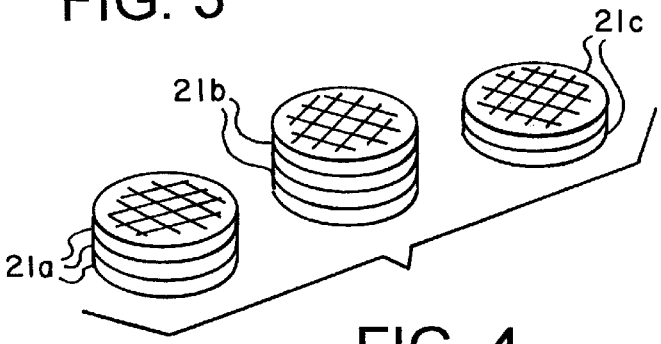
FIG. 4 is a perspective view of gaming chips usable with the board game of the invention.

A further aspect of the board game of the invention is provided by utilizing conventional gaming or so-called "poker" chips, 21*a*, 21*b* and 21*c*, FIG. 4, which may be issued or provided in conventional value associated colors of white, red and blue, respectively, merely as a means of minimizing the number of chips used in the game. A chart 26 shown in FIGS. 1 and 1B indicates, by way of example, values or "credits" assigned to particular chips and the number of so-called "credits" earned as a result of a roll of the dice. As indicated in chart 26, so-called chip credits are earned by rolling a particular combination of numbers of the dice, such as two pair, three of a kind, four of a kind, or a numerical sequence. Still further, chip credits may be earned by a player who is challenging another player's answer to a question or by the player who is being challenged, if the challenger is incorrect and the player answering the question gives the correct answer.

Referring again briefly to FIG. 3, a preferred embodiment of the game of the present invention utilizes the four conventional gaming dice 19*a* through 19*d*. Any combination of colors may be selected for the dice 19*a* through 19*d* and coordinated with the grids 20 and 22. The total number of dice may be more or less than the four indicated in conjunction with the exemplary embodiment of the game.

Figure 5:
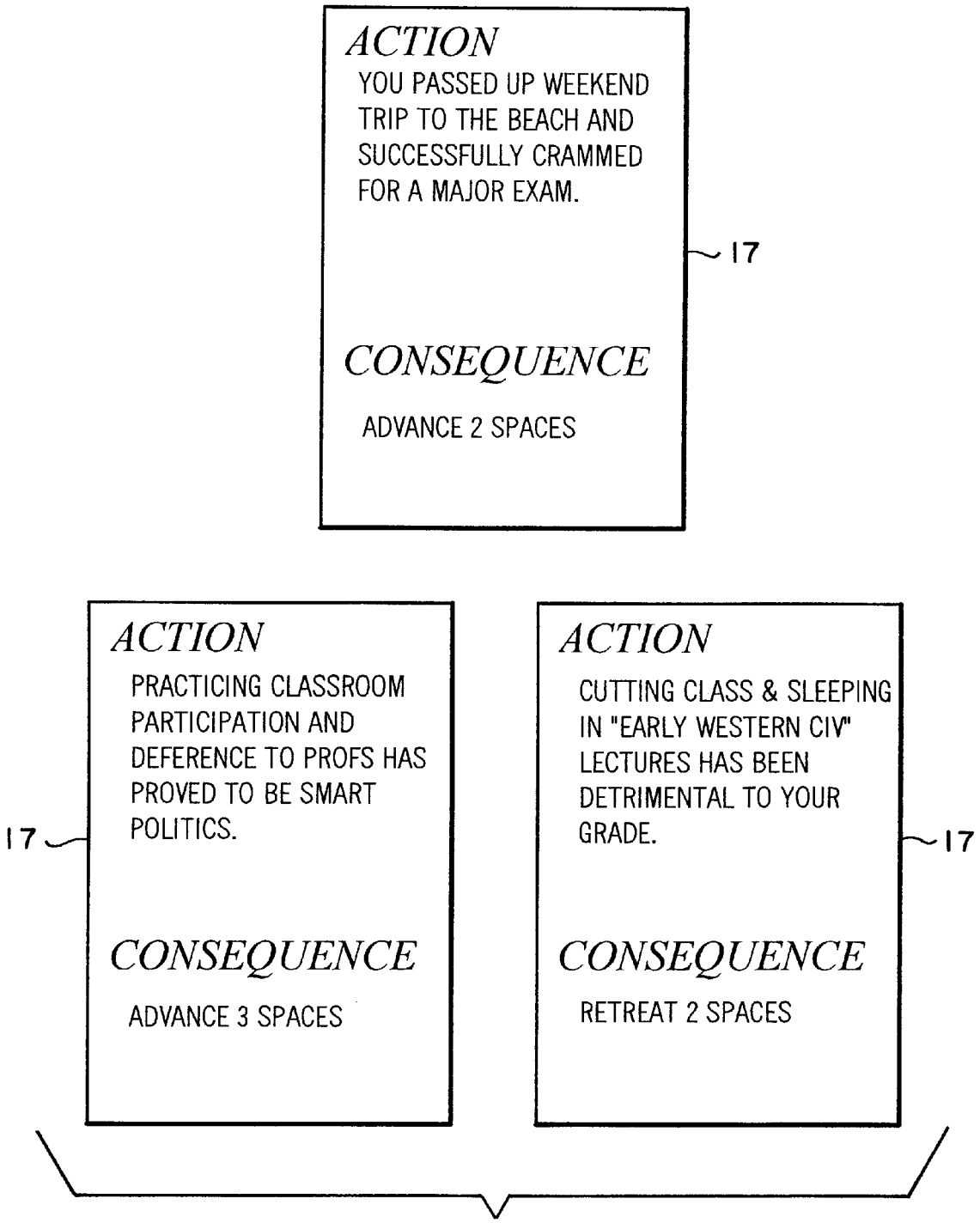
FIG. 5 is a plan view of an exemplary selection of a set of cards showing "action" and "consequence" statements printed thereon.

Referring now to FIG. 5, a further aspect of the board game of the invention is provided by the cards 17, three shown face up by way of example, wherein on each card "Action" and "Consequence" statements are provided. The game board spaces 16*c*, FIG. 1 are designated as spaces which, if a player lands on such a space with his playpiece during game play, is required to select a card 17 from the stack. If it is required to select one of the cards shown in FIG. 5, the consequences of that card selection must be carried out by the player, such as moving a predetermined number of spaces 16*b* and 16*c* forward or backward along the game travel path 14.

Still further, referring briefly to FIG. 6, there is illustrated, by way of example, a form of presentation of a set of questions from a subject matter category question and answer "book" 23 shown open to a page 23*a* with selected questions and answers shown thereon and wherein each question has a three-digit number which was selected or determined during a roll of the dice. The questions are each associated with multiple choice answers, only one of which is correct.

In accordance with one aspect of the game, the player being asked the question is given the option of choosing the correct answer from the multiple choices or answering the question without being advised of the multiple choices. This presents a risk/reward opportunity to the player wherein, if the player chooses to answer the question without being advised of the multiple choices and gives the correct answer, the player is awarded more credits than if the player chooses an answer from multiple choices. Of course, credits are awarded in either case only when a correct answer is given from the two answer options. The game may also be played wherein the player being asked the question chooses from the multiple choice answers, or the game may be played wherein the player is required to answer the question whose number has been rolled without any choices. The opposite side of each page of questions is provided with the correct answer and commentary regarding same, as indicated for page 23*b* in FIG. 7 for the questions of page 23*a*. The book 23 may, of course, be a bound set of pages or unbound sets of cards or sheets with questions and answers printed thereon. Other forms of presentation of the questions and answers may be provided.

Those skilled in the art will appreciate from the foregoing description of the major structural features of the game that the game objective is to accumulate enough "credits" during the game to advance along the game board from the start space 16*a* to the finish space 16*d* before any of the players opponents. The game is preferably played with from two to six players and the order of player turns may be determined by any selection process such as, for example, an initial roll of the dice by each player with the player rolling the lowest or highest number, or combination of numbers, allowed to play first, for example. Prior to commencement of play, the cards 17 are shuffled in a deck and placed face down on a designated space such as space 15, FIG. 1, on the game board 10, for example. Each player then selects a playpiece 18*a* through 18*f* and places his or her playpiece on the start or "enrollment" space 16*a* on the game board 10. As shown by way of example only in FIG. 1, advancement along the travel path 14 is in a counter clockwise direction and players may sit at the game board in the order of their "turn" to play as determined by an initial dice roll, for example.

A player or a non-player may be selected as the question reader. Typically, a player whose turn has just been completed becomes the question reader to minimize the chance that a question on the same page as a question just read will come up for an immediately succeeding player and give that player an advantage of answering from memory after having just viewed the question and answer pages. Although two die grids have been described above for the game board 10, the game may be played with only one grid or up to six grids, chosen by the roll of the blue die, for example.

The question selection process involves a roll of the dice 19*a* through 19*d*, as previously described. Specifically, the question selection process involves a roll of all four dice followed by arranging the red, white and blue dice on the die grid selected by the roll of the blue die if more than one die grid is provided. The resulting 3-digit number provided by the white dice and blue die determines the question number and the category number is determined by the roll of the red die. The question and answer or playbook 23 is then opened to the selected category and question number once a player has rolled all four dice after start of the game. As shown in FIGS. 6 and 7, the questions and answers will appear on the front of the appropriate page and the correct answers and commentary, if any, on the back of the same page or on the back of a previous page of the book. Each subject matter category contains 216 questions and answers if four dice are used and a die grid as described above is used. The lowest question and answer number in each category is, for example, 111 and the highest number is 666. For the exemplary game of the invention, a total of 1,296 questions and answers (with or without commentary) may be provided for all six categories of subject matter.

The basic rules of play of the board game of the invention are carried out by initiating play through, for example, a roll of a single die by each player and wherein the player with the highest number begins play followed by the player with the next highest number from rolling the single die, and so on. Other selection processes for the order of play may be carried out. Once a question reader has been selected, such as the last player in the order of play or a non-player, the first player, herein sometimes designated the "roller", rolls the dice for question selection.

After a selected question is read by the reader, the roller may ask to read the question directly from the book 23 after covering the multiple choice answers or covering the answer page. In this regard, as shown in FIG. 6, a separate card or bookmark, shown in phantom and indicated by the numeral 23*c*, may be placed over the portion of the page 23*a* containing the multiple choice answers or covering the answer page. The bookmark or card 23*c* may be provided with suitable colorful indicia associated with the theme of the game. The roller may respond with an answer or request recitation by the reader of the multiple choices. If the roller gives an answer without the benefit of multiple choices, the reader then reads aloud the three choices, the correct answer and any commentary from the book 23. If the correct answer matches the roller's answer, the roller is entitled to advance his/her playpiece along the travel path 14 in a counterclockwise direction a number of spaces equal to, for example, the sum of numbers shown on the white dice from the player's roll of the dice plus, if desired, a predetermined number of additional spaces. Alternatively, if the roller or player whose turn is being executed requests multiple choices for answers, the reader reads the choices aloud prior to giving the answer and whereupon the roller responds with an answer. If the answer is correct, the reader so indicates and may read any comments from the book 23 after which the roller may advance the number of spaces equal only to the number shown on the white dice from the player's roll thereof.

After a player completes his or her turn, play passes to the next player in a counterclockwise direction, by way of example, and the next player carries out the game process just described. Play ends when either (a) a player advances around the game board to the finish or "graduation" space 16*d*; or (b) game time expires, based on a predetermined limit.

Additional aspects of the board game of the invention are as follows. For example, as shown in FIG. 1, the game board 10 may include colors and numbers associated with each of the spaces 16*b* which match colors and numbers of the die 19*a* through 19*d*. In this regard each or selected ones of the spaces 16*b* may include indicia 16*e* showing a face of one of the dice 19*a* through 19*d* with an appropriate die number and color indicated thereon. If, during a turn of play, a player rolls a number and color on any of the four die that matches a number and color of a space 16*b* occupied by that player's playpiece, the player must then draw a card 17 and exercise the "Consequence" described on that card. This action precedes the normal play process of the player's turn described above. Accordingly, a player may advance or retreat one or more spaces 16*b*, 16*c* from the player's position on the board 10 prior to being awarded an advance along the travel path as a consequence of a correct answer to a question.

Another aspect of a game in accordance with the invention which may be exercised, is one of allowing a player an extra turn, including a roll of the dice if, during a turn a player's playpiece is advanced to a space associated with that player's chosen number. In other words, the player's number chosen to start the game, for example, may be recalled and used to add this aspect to the play during a player's turn at play.

The use of the gaming chips 21*a* through 21*c*, previously discussed, may be implemented in a feature of the game wherein, if a player lands on a space 16*b* along the travel path 14 which is of the same color or bears indicia the same as on that player's as the playpiece, the player may collect credits from a "bank" of gaming chips 21*a* through 21*c* of a predetermined value. For example, if such an event occurs known as a "color landing", the player may collect two white chips (6 credits) from the gaming chip bank. All gaming chips which are not in possession of a player during game play are held in the "bank". Indicia 16*f* and 16*g* on spaces 16*b*, FIG. 1, correlatable with indicia 18*a*' and 18*c*', for example, on the player's playpiece, or other graphic representations, may be used in addition to or instead of colors.

A further aspect of the game which may be implemented is known as a "double landing." This is a situation wherein a player's playpiece lands on a space 16*b* on the travel path 14 bearing the player's chosen number and color or other correlatable indicia. In this situation, the player is entitled to an extra roll of the dice and collection from the bank of a predetermined number of credits corresponding to the appropriate number of gaming chips.

Of course, as previously described, selected landing spaces 16*c* along the travel path 14 may be identified in connection with the stack of cards 17, and if a player lands on a space 16*c* during a playing turn, a card must be drawn and the consequence of that card carried out, such as advancing or retreating the number of spaces indicated under the "consequence" heading on the card in question.

Figure 1F:
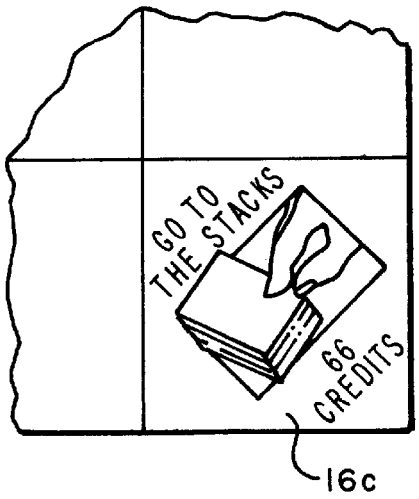
Figure 1D:
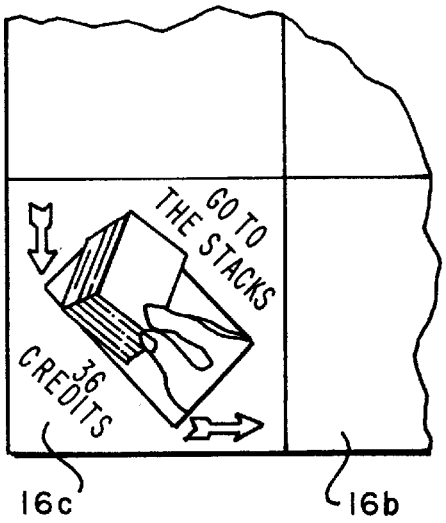
Figure 1G:
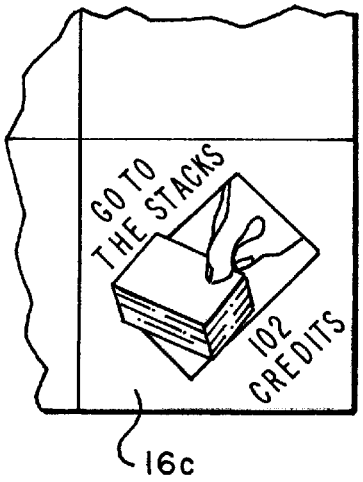
Figure 1E:
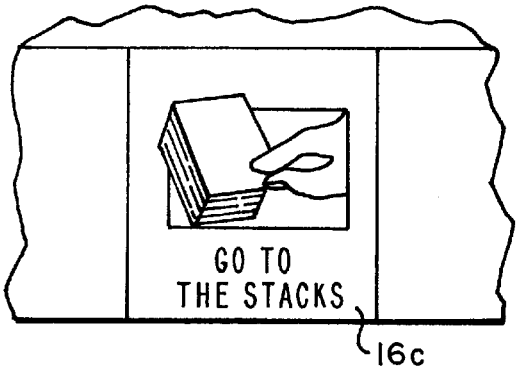
Figure 1H:
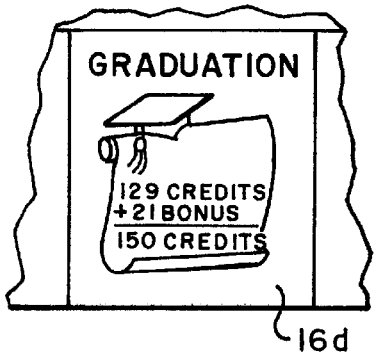

Another aspect of the game of the present invention is the assignment of point values or "credits" associated with various actions which take place during game play. A player may be awarded "space" credits or points when moving along the travel path 14. For example, each space 16*a* through 16*c* advanced toward the finish or graduation space 16*d* earns the player a predetermined number of space credits. The game board may have suitable indicia thereon, see FIGS. 1D, 1F and 1G, indicating the space credit subtotals associated with reaching that space along the travel path 14. At the end of the game, the space points or credits may be added together with any unused "chip" points or credits to arrive at a grand point (or "credit") total to determine the player's standing in the game if that player has not finished first.

So-called chip points or credits may be earned by the combination of numbers rolled with the dice 19*a* through 19*d*, and as a consequence of landing on a space 16*b* on the travel path 14 of the player's chosen color, chosen color and number simultaneously, or as a consequence of winning betting "pots" or amounts. Both space points and chip points or "credits" are won or lost as a consequence of certain actions in the game. For example, space credits are lost as a consequence of moving backward along the travel path 14, which action is the result of drawing a card 17 which requires such a penalty.

Another aspect of the board game of the invention involves the use of so-called chip points or credits which are points associated with the various gaming chips used, for example, white chips, red chips and blue chips may be assigned specific point values. During a player's turn at play, the player may place a bet with a predetermined number of that player's chips after rolling the dice 19*a* through 19*d* and determining the question category but before hearing the question read. Any other player may challenge the first mentioned player and match the point value of the bet with such other player's chips. The player offering the correct answer whether it be the "roller" or "challenger" is awarded the betting "pot". However, the rules may require a certain point value charged to the challenger which is paid to the chip bank. Still further, the player offering the correct answer may advance his playpiece the normal spaces forwarded (such as the number shown on the white dice rolled) to initiate the play event, plus a predetermined multiple. Still further, the player offering the correct answer may advance his playpiece the additional spaces forward on the board travel path 14 at an exchange rate of one space for each fifteen chip points bet up to a maximum of a predetermined number of spaces.

The challenge aspect of the game of the invention may be carried out once during each player's turn at play with regard to answering a question. Any player may initiate a challenge by announcing the term "challenge" and simultaneously surrendering one or more chips 21*a*, 21*b* or 21*c* as required to the chip bank. If the player whose turn is being "challenged" has placed a bet, the challenger must also match that bet by placing the requisite number of chips in the "pot". The reward for a correct challenge is the same as the player or "roller" would have received for a correct answer that is by advancing the appropriate number of spaces 16*b* or 16*c* along the travel path 14 plus collecting any of the gaming chips in the betting pot.

After any challenge, play resumes as normal, that is the next turn goes to the player who would have had the turn had the challenge not occurred. The player who is serving as the reader may be penalized one gaming chip if the reader fails to allow sufficient time for a challenge round to occur after a roller or challenger offers an answer.

Basically, the winner of the game of the present invention is the player who has reached the finish or "graduation" space 16*d* on the board travel path 14. All other players may then swap gaming chip points for so-called space points by returning their chips to the gaming chip bank in exchange for advancing the correlated number of spaces along the board travel path, each space, being worth a predetermined number of points. Players who reach the finish space 16*d* receive a predetermined number of "bonus" or credit points either by arriving first and ending the game or by swapping chip points when play ends. After all players have advanced as far as possible, the player with the most points, that is space points and excess chip points, may be declared the actual winner.

Those skilled in the art will appreciate from the foregoing description that a major game strategy pertains to manipulating the player's position on the board travel path. Such may be done by "looking ahead" on the board and finding a potentially desirable landing space among the spaces 16*b* and 16*c* and then considering the spaces that may be advanced based on the number shown on the white die as a consequence of a dice roll during a player's turn. Still further, a play strategy involves assessing the probability of correctly answering a question and placing or not placing a bet to increase the number of spaces that a player may advance for a correct answer.

An example of a player's strategy exercise is as follows. Assuming that the player whose turn at play is occurring is seven spaces behind the next space where that player's assigned number is indicated at 16*e* on a travel path space 16*b*. This is a desired spot to land since it would entitle the player to an extra turn. Consequently, a player in this situation rolls the dice and the white die turns up (4) and the red die turns up (1). Category (1) happens to be a subject in which the player lacks confidence in the ability to answer a question. There are two ways for the player to get to the targeted landing space: (i) by answering the question correctly without selecting the multiple choice mode of answering, or (ii) by betting with chips a predetermined number of points and answering the question correctly with multiple choice. If the player has a sufficient number of gaming chips, the best strategy is probably to bet and use the multiple choice option to answer the question. On the other hand, if the red die turns up a numeral (6), a subject category in which the player is very knowledgeable, then the best strategy might be to forego any bet and attempt to answer the question without the benefit of multiple choice. In any case, the strategy is, as mentioned above, to "look ahead" on the board 10 with respect to the landing spaces 16*b* and 16*c* available and estimate the probability of a successful move.

Those skilled in the art will appreciate from the foregoing description that a particularly advantageous, educational and entertaining board game is provided by the present invention. The subject matter or theme of the board game may vary and may be based on one of many categories of subject matter. The "college athletic conference" theme of the exemplary embodiment of the game described above is primarily for purposes of illustration of the basic features of the game only. The structural components of the game may be provided of conventional materials used for board games, and using conventional manufacturing processes. Moreover, the features, advantages and rules of play described above are believed to be set forth in sufficient detail as to enable those skilled in the art to practice the invention. Still further, various substitutions and modifications may be made without departing from the scope and spirit of the appended claims.

What is claimed is:

1. An educational board game comprising a game apparatus including:

a game board including a playing surface formed thereon, said playing surface including a travel path for one or more playpieces, said travel path being divided into a plurality of spaces arranged seriatim between a start space and a finish space along said travel path;

a plurality of game playpieces, each playpiece being adapted to be placed on a space on said travel path;

a set of dice; and a book of questions including a predetermined number of questions, each question being uniquely identified by assigning a unique number to each question, said unique having a number associated with a number on a combination of at least two dice of said set.

2. The board game set forth in claim 1 including:

a grid for correlating a number rolled for at least a selected number of said dice for determining at least one of a category of questions and a question number in said book.

3. The board game set forth in claim 2 wherein:

said grid is printed on said game board.

4. The board game set forth in claim 2 wherein:

said grid includes spaces for selected dice of said set arranged in a predetermined order to determine the question number to be selected in said book.

5. The board game set forth in claim 4 wherein:

said grid includes a plurality of spaces for correlation with at least one die of said set to determine a subject matter category for questions in said book.

6. The board game set forth in claim 1 wherein:

at least selected ones of said spaces on said travel path include indicia correlatable with indicia on selected ones of said playpieces, respectively.

7. The board game set forth in claim 1 wherein:

at least selected ones of said spaces on said travel path include a number associated therewith respectively, and correlatable with a number on at least one die of said set.

8. The board game set forth in claim 1 wherein:

selected ones of said spaces on said travel path include indicia indicating play action to be taken comprising at least one of loss of turn, retreat a predetermined number of spaces toward said start space and advance a predetermined number of spaces toward said finish space.

9. The board game set forth in claim 1 including plural cards, each of said cards including indicia thereon indicating an action to be taken by a player drawing said card from a stack of said cards.

10. The board game set forth in claim 9 wherein:

at least one space along said travel path includes indicia identifying said one space as being associated with a source of said cards whereby a playpiece occupying said one space requires a player to select a card and take action as directed on said card.

11. The board game set forth in claim 1 including:

a plurality of gaming chips having pre-assigned values related to a value assigned to each space on said travel path, and wherein the value of said space on said travel path is related to its distance in terms of number of spaces from said start space.

12. The board game set forth in claim 1 wherein:

said book includes a plurality of questions presented therein and selected from a predetermined category of subject matter.

13. The board game set forth in claim 12 wherein:

each of said questions in said book includes a finite list of answers to provide multiple choices of a correct answer.

14. The board game set forth in claim 12 wherein:

said book includes a plurality of answers presented therein and each of said questions in said book includes a corresponding answer identified by the same identification as said question.

15. In a board game adapted for play by multiple players, a game apparatus including:

a game board including a playing surface formed thereon, said playing surface including a travel path for plural playpieces, said travel path being divided into a plurality of spaces disposed between a "start" space and a "finish" space on said travel path;

a plurality of playpieces, each playpiece being adapted to be placed on a space on said travel path and advanced from one space to another along said travel path from said start space to said finish space;

a set of dice;

a grid for correlating numbers rolled for each die of said set of dice for determining one of a category of questions to be asked of a player whose turn it is to advance a playpiece along said travel path and for determining a specific question within said category; and a set of questions including a predetermined number of questions in predetermined categories, each question being identified by a number corresponding to a number rolled on a combination of at least two dice of said set.

16. The board game set forth in claim 15 wherein:

said set of dice comprises four dice and said grid is arranged to identify a selected category of subject matter based on a roll of one die of said set and a number identifying a question within said category is based on a roll of three dice of said set.

17. The board game set forth in claim 15 wherein:

said grid is printed on said game board.

18. The board game set forth in claim 15 wherein:

at least selected ones of said spaces on said travel path include indicia correlatable with indicia on selected ones of said playpieces, respectively.

19. The board game set forth in claim 15 wherein:

selected ones of said spaces on said travel path include indicia indicating play action to be taken comprising at least one of loss of turn at play, retreat one's playpiece a predetermined number of spaces toward said start space, and advance said playpiece a predetermined number of spaces toward said finish space.

20. The board game set forth in claim 15 including:

a predetermined number of cards, each of said cards including indicia thereon indicating a consequence of drawing said card from a stack of said cards and a predetermined number of spaces along said travel path include indicia identifying each of said predetermined spaces as being associated with said cards whereby a playpiece occupying one of said predetermined spaces requires a player to select a card and take action as directed by said selected card.

21. A method of playing a game which includes a game apparatus comprising a game board having a playing surface with a travel path identified thereon, said travel path including a plurality of finite spaces between a start space and a finish space, a set of dice, plural playpieces for use by individual players of said game and a set of printed questions, each of said questions being uniquely identified from each other by assigning a unique number to each question, said unique number correlatable with a number on one or more dice of said set, said method comprising each of plural players taking a turn at play of said game comprising the steps of:

placing a playpiece on a space on said travel path;

rolling said dice;

identifying a question of said set of questions based on a combination of numbers rolled on at least two dice of said set;

attempting an answer to a question identified by said combination of numbers; and advancing said playpiece along said travel path toward said finish space if a correct answer is given to said question.

22. The method set forth in claim 21 including the step of:

providing a selected number of cards as part of said game apparatus, each of said cards including a play action to be taken during a player's turn at play of said game as a consequence of a playpiece occupying one of a selected number of spaces on said travel path; and drawing a card from a stack of said cards as a consequence of a player's playpiece occupying one of said selected number of spaces on said travel path and taking the action with said playpiece as required by the action stated on said card.

23. The method set forth in claim 21 wherein:

said game board includes indicia on selected ones of said spaces on said travel path correlatable with one of a playpiece and a number rolled by selected die of said set and said method includes the step of a player acquiring an extra turn at play as a consequence of that player's playpiece occupying one of said spaces having indicia thereon correlatable with indicia on that player's playpiece and a number rolled during a turn at play corresponding to a die number associated with said space.

24. The method set forth in claim 21 wherein:

said game apparatus includes plural gaming chips and said method comprises the step of;

awarding a player a predetermined number of chips as a consequence of a predetermined combination of die numbers resulting from a roll of said set of dice during a turn at play.

25. The method set forth in claim 21 including the steps of:

providing said game apparatus with a plurality of K gaming chips and assigning values to select ones of said chips, and said method includes the step of;

one of said plural players challenging an answer given to a question by a player whose turn at play requires giving an answer to a question and surrendering or being rewarded with a predetermined number of chips as a consequence of whether or not the challenger's answer to the question being challenged is correct or incorrect.

* * * * *